US006085991A

United States Patent [19]

Sturman

[11] Patent Number: 6,085,991

[45] Date of Patent: Jul. 11, 2000

[54] INTENSIFIED FUEL INJECTOR HAVING A LATERAL DRAIN PASSAGE

[76] Inventor: Oded E. Sturman, One Innovation Way, Woodland Park, Colo. 80863

[21] Appl. No.: 09/078,845

[22] Filed: May 14, 1998

[51] Int. Cl.[7] ..... F02M 47/02

[52] U.S. Cl. ..... 239/88; 239/533.9

[58] Field of Search ..... 239/88, 89, 96, 239/533.2, 533.3, 533.9; 251/129.1

[56] References Cited

U.S. PATENT DOCUMENTS

| | | |
|---|---|---|
| 33,270 | 7/1990 | Beck et al. . |
| 892,191 | 6/1908 | Shuller . |
| 1,700,228 | 1/1929 | Kendall . |

(List continued on next page.)

FOREIGN PATENT DOCUMENTS

| | | |
|---|---|---|
| 0 149 598 A2 | 7/1985 | European Pat. Off. . |
| 0 184 940 A2 | 6/1986 | European Pat. Off. . |
| 0 331 198 A2 | 9/1989 | European Pat. Off. . |
| 0 375 944 A2 | 7/1990 | European Pat. Off. . |
| 0 425 236 A1 | 5/1991 | European Pat. Off. . |
| 0 245 373 B1 | 3/1992 | European Pat. Off. . |
| 892121 | 3/1962 | Germany . |
| 2 209 206 | 8/1973 | Germany . |
| 40 29 510 A1 | 3/1991 | Germany . |
| 41 18 236 A1 | 12/1991 | Germany . |
| 44 01 073 A1 | 7/1995 | Germany . |
| 195 23 337 A | 1/1996 | Germany . |
| 4-341653 | 11/1992 | Japan . |
| 981664 | 12/1982 | Russian Federation . |
| 264710 | 10/1949 | Switzerland . |
| 349165 | 6/1931 | United Kingdom . |
| 1465283 | 3/1977 | United Kingdom . |
| 2 308 175 | 9/1998 | United Kingdom . |
| WO 97/27865 | 10/1995 | WIPO . |
| WO 96/07820 | 3/1996 | WIPO . |
| WO 96/08656 | 3/1996 | WIPO . |
| WO 96/17167 | 6/1996 | WIPO . |
| WO 97/02423 | 1/1997 | WIPO . |

OTHER PUBLICATIONS

North American Edition, Diesel Progress, Apr. 1997, Developments in Digital Valve Technology by Rob Wilson.

North American Edition, Diesel Progress, Aug. 1997, Vickers Taking Closer Aim at Mobile Markets, by Mike Brezonick.

"The Swing to Cleaner, Smarter Hydraulics", Industrial Management & Technology, Fortune 152[A], Jun. 1997 by Stuart Brown.

Electronic Unit Injectors–Revised, G. Frankl, G.G Barker and C.T Timms, Copyright 1989 SOciety of Automotive Engineers, Inc.

SAE Technical Paper Series, Benefits of New Fuel Injection System Technology on Cold Startability of Diesel Engines—Improvement of Cold Startability and White Smoke Reduction.

by Means of Multi Injection with Common Rail Fuel System (ECD–U2), Isao osuka et al., Feb. 28–Mar. 3, 1994.

(List continued on next page.)

*Primary Examiner*—Lesley D. Morris

*Attorney, Agent, or Firm*—Blakely, Sokoloff, Taylor & Zafman LLP

[57] ABSTRACT

An intensified fuel injector which has at least one lateral or side drain passage. The fuel injector may include a valve body which has longitudinal axis. The valve body may have a fuel chamber that is hydraulically coupled to a fuel supply port and at least one nozzle opening. An intensifier moves within the fuel chamber. The intensifier is hydraulically coupled to an intensifier chamber and also connected to a biasing spring. The spring is located within a spring chamber that is hydraulically coupled to the drain passage. The drain passage may extend through the valve body in a direction that is substantially perpendicular to the longitudinal axis of the body. The orientation and position drain passage minimizes the diameter or cross-sectional area of the fuel injector by eliminating a longitudinal passage typically found in fuel injectors of the prior art.

12 Claims, 4 Drawing Sheets

U.S. PATENT DOCUMENTS

| | | |
|---|---|---|
| 2,144,862 | 1/1939 | Truxell, Jr. . |
| 2,421,329 | 5/1947 | Hoffer . |
| 2,434,586 | 1/1948 | Reynolds . |
| 2,535,937 | 12/1950 | Le Bozec et al. . |
| 2,552,445 | 5/1951 | Nielsen . |
| 2,597,952 | 5/1952 | Rosenlund . |
| 2,621,011 | 12/1952 | Smith . |
| 2,672,827 | 3/1954 | McGowen, Jr. . |
| 2,727,498 | 12/1955 | Reiners . |
| 2,749,181 | 6/1956 | Maxwell et al. . |
| 2,793,077 | 5/1957 | Bovard . |
| 2,912,010 | 11/1959 | Evans et al. . |
| 2,916,048 | 12/1959 | Gunkel . |
| 2,930,404 | 3/1960 | Kowalski et al. . |
| 2,934,090 | 4/1960 | Kenann et al. . |
| 2,945,513 | 7/1960 | Sampeitro . |
| 2,967,545 | 1/1961 | Schmidt . |
| 2,985,378 | 5/1961 | Falberg . |
| 3,035,780 | 5/1962 | Peras . |
| 3,057,560 | 10/1962 | Campbell . |
| 3,071,714 | 1/1963 | Hadekel . |
| 3,175,771 | 3/1965 | Breting . |
| 3,368,791 | 2/1968 | Wells . |
| 3,391,871 | 7/1968 | Fleischer et al. . |
| 3,408,007 | 10/1968 | Raichle et al. . |
| 3,410,519 | 11/1968 | Evans . |
| 3,458,769 | 7/1969 | Stampfli . |
| 3,512,557 | 6/1950 | Weldy . |
| 3,532,121 | 10/1970 | Sturman . |
| 3,570,806 | 3/1971 | Sturman . |
| 3,570,807 | 3/1971 | Sturman . |
| 3,570,833 | 3/1971 | Sturman et al. . |
| 3,575,145 | 4/1971 | Steiger . |
| 3,585,547 | 6/1971 | Sturman . |
| 3,587,547 | 6/1971 | Hussey . |
| 3,604,959 | 9/1971 | Sturman . |
| 3,675,853 | 7/1972 | Lapera . |
| 3,683,239 | 8/1972 | Sturman . |
| 3,689,205 | 9/1972 | Links . |
| 3,718,159 | 2/1973 | Tennis . |
| 3,731,876 | 5/1973 | Showalter . |
| 3,743,898 | 7/1973 | Sturman . |
| 3,753,426 | 8/1973 | Lilley . |
| 3,753,547 | 8/1973 | Topham . |
| 3,796,205 | 3/1974 | Links et al. . |
| 3,814,376 | 6/1974 | Reinicke . |
| 3,821,967 | 7/1974 | Sturman et al. . |
| 3,827,409 | 8/1974 | O'Neill . |
| 3,835,829 | 9/1974 | Links . |
| 3,858,135 | 12/1974 | Gray . |
| 3,868,939 | 3/1975 | Friese et al. . |
| 3,921,604 | 11/1975 | Links . |
| 3,921,901 | 11/1975 | Woodman . |
| 3,989,066 | 11/1976 | Sturman et al. . |
| 3,995,652 | 12/1976 | Belart et al. . |
| 4,046,112 | 9/1977 | Deckard . |
| 4,064,855 | 12/1977 | Johnson . |
| 4,065,096 | 12/1977 | Frantz et al. . |
| 4,069,800 | 1/1978 | Kanda et al. . |
| 4,077,376 | 3/1978 | Thoma . |
| 4,080,942 | 3/1978 | Vincent et al. . |
| 4,083,498 | 4/1978 | Cavanagh et al. . |
| 4,087,736 | 5/1978 | Mori et al. . |
| 4,087,773 | 5/1978 | Jencks et al. . |
| 4,107,546 | 8/1978 | Sturman et al. . |
| 4,108,419 | 8/1978 | Sturman et al. . |
| 4,114,647 | 9/1978 | Sturman et al. . |
| 4,114,648 | 9/1978 | Nakajima et al. . |
| 4,120,456 | 10/1978 | Kimura et al. . |
| 4,152,676 | 5/1979 | Morgenthaler et al. . |
| 4,165,762 | 8/1979 | Acar . |
| 4,182,492 | 1/1980 | Albert et al. . |
| 4,189,816 | 2/1980 | Chalansonnet . |
| 4,192,466 | 3/1980 | Tanasawa et al. . |
| 4,217,862 | 8/1980 | Fort et al. . |
| 4,219,154 | 8/1980 | Luscomb . |
| 4,221,192 | 9/1980 | Badgley . |
| 4,231,525 | 11/1980 | Palma . |
| 4,246,876 | 1/1981 | Bouwkamp et al. . |
| 4,248,270 | 2/1981 | Ostrowski . |
| 4,260,333 | 4/1981 | Schillenger . |
| 4,266,727 | 5/1981 | Happel et al. . |
| 4,271,807 | 6/1981 | Links et al. . |
| 4,273,291 | 6/1981 | Muller . |
| 4,275,693 | 6/1981 | Leckie . |
| 4,279,385 | 7/1981 | Straubel et al. . |
| 4,308,891 | 1/1982 | Loup . |
| 4,319,609 | 3/1982 | Debrus . |
| 4,329,951 | 5/1982 | Seilly . |
| 4,342,443 | 8/1982 | Wakeman . |
| 4,346,681 | 8/1982 | Schleicher et al. . |
| 4,354,662 | 10/1982 | Thompson . |
| 4,372,272 | 2/1983 | Walter et al. . |
| 4,375,274 | 3/1983 | Thoma et al. . |
| 4,378,775 | 4/1983 | Straubel et al. . |
| 4,381,750 | 5/1983 | Funada . |
| 4,392,612 | 7/1983 | Deckard et al. . |
| 4,396,037 | 8/1983 | Wilcox . |
| 4,396,151 | 8/1983 | Kato et al. . |
| 4,405,082 | 9/1983 | Walter et al. . |
| 4,409,638 | 10/1983 | Sturman et al. . |
| 4,413,600 | 11/1983 | Yanagawa et al. . |
| 4,414,940 | 11/1983 | Loyd . |
| 4,422,424 | 12/1983 | Luscomb . |
| 4,425,894 | 1/1984 | Kato et al. . |
| 4,437,443 | 3/1984 | Hofbauer . |
| 4,440,132 | 4/1984 | Terada et al. . |
| 4,440,134 | 4/1984 | Nakao et al. . |
| 4,448,169 | 5/1984 | Badgley et al. . |
| 4,449,507 | 5/1984 | Mayer . |
| 4,457,282 | 7/1984 | Muramatsu et al. . |
| 4,459,959 | 7/1984 | Terada et al. . |
| 4,462,368 | 7/1984 | Funada . |
| 4,480,619 | 11/1984 | Igashira et al. . |
| 4,482,094 | 11/1984 | Knape . |
| 4,486,440 | 12/1984 | Carlson et al. . |
| 4,501,290 | 2/1985 | Sturman et al. . |
| 4,506,833 | 3/1985 | Yoneda et al. . |
| 4,516,600 | 5/1985 | Sturman et al. . |
| 4,518,147 | 5/1985 | Andersen et al. . |
| 4,526,145 | 7/1985 | Honma et al. . |
| 4,526,519 | 7/1985 | Mowbray et al. . |
| 4,527,738 | 7/1985 | Martin . |
| 4,540,126 | 9/1985 | Yoneda et al. . |
| 4,541,387 | 9/1985 | Morikawa . |
| 4,541,390 | 9/1985 | Steinbrenner et al. . |
| 4,541,454 | 9/1985 | Sturman et al. . |
| 4,550,875 | 11/1985 | Teerman et al. . |
| 4,554,896 | 11/1985 | Sougawa . |
| 4,557,685 | 12/1985 | Gellert . |
| 4,558,844 | 12/1985 | Donahue, Jr. . |
| 4,568,021 | 2/1986 | Deckard et al. . |
| 4,572,132 | 2/1986 | Piwonka . |
| 4,599,983 | 7/1986 | Omachi . |
| 4,603,671 | 8/1986 | Yoshinaga et al. . |
| 4,604,675 | 8/1986 | Pflederer . |
| 4,605,166 | 8/1986 | Kelly . |
| 4,610,428 | 9/1986 | Fox . |
| 4,611,632 | 9/1986 | Kolchinsky et al. . |
| 4,619,239 | 10/1986 | Wallefang et al. . |
| 4,625,918 | 12/1986 | Funada et al. . |
| 4,627,571 | 12/1986 | Kato et al. . |

4,628,881 12/1986 Beck et al. .
4,648,580 3/1987 Kuwano et al. .
4,653,455 3/1987 Eblen et al. .
4,658,824 4/1987 Schiebe .
4,669,429 6/1987 Nishida et al. .
4,681,143 7/1987 Sato et al. .
4,684,067 8/1987 Cotter et al. .
4,699,103 10/1987 Tsukahara et al. .
4,702,212 10/1987 Best et al. .
4,715,541 12/1987 Fruedenschuss et al. .
4,719,885 1/1988 Nagano et al. .
4,721,253 1/1988 Noguchi et al. .
4,726,389 2/1988 Minoura et al. .
4,728,074 3/1988 Igashira et al. .
4,741,365 5/1988 Van Ornum .
4,741,478 5/1988 Teerman et al. .
4,753,416 6/1988 Inagaki et al. .
4,770,346 9/1988 Kaczynski .
4,785,787 11/1988 Riszk et al. .
4,787,412 11/1988 Wigmore et al. .
4,794,890 1/1989 Richeson, Jr. .
4,798,186 1/1989 Ganser .
4,807,812 2/1989 Rrenowden et al. .
4,811,221 3/1989 Sturman et al. .
4,812,884 3/1989 Mohler .
4,813,599 3/1989 Greiner et al. .
4,821,773 4/1989 Heiron et al. .
4,825,842 5/1989 Steiger .
4,826,080 5/1989 Ganser .
4,831,989 5/1989 Haines .
4,838,230 6/1989 Matsuoka .
4,838,310 6/1989 Scott et al. .
4,841,936 6/1989 Takahashi .
4,869,218 9/1989 Fehlmann et al. .
4,869,429 9/1989 Brooks et al. .
4,870,939 10/1989 Ishikawa et al. .
4,875,499 10/1989 Fox .
4,877,187 10/1989 Daly .
4,884,545 12/1989 Mathis .
4,884,546 12/1989 Sogawa .
4,893,102 1/1990 Bauer .
4,893,652 1/1990 Nogles et al. .
4,905,120 2/1990 Grembowicz et al. .
4,909,440 3/1990 Mitsuyasu et al. .
4,922,878 5/1990 Shinogle et al. .
4,928,887 5/1990 Miettaux .
4,955,334 9/1990 Kawamura .
4,957,084 9/1990 Kramer et al. .
4,957,085 9/1990 Sverdlin .
4,964,571 10/1990 Taue et al. .
4,974,495 12/1990 Richeson, Jr. .
4,979,674 12/1990 Taira et al. .
4,993,637 2/1991 Kanesaka .
5,004,577 4/1991 Ward .
5,016,820 5/1991 Gaskell .
5,036,885 8/1991 Miura .
5,037,031 8/1991 Campbell et al. .
5,042,445 8/1991 Peters et al. .
5,048,488 9/1991 Bronkal .
5,049,971 9/1991 Krumm .
5,050,543 9/1991 Kawamura .
5,050,569 9/1991 Beunk et al. .
5,054,458 10/1991 Wechem et al. .
5,056,488 10/1991 Eckert .
5,067,658 11/1991 De Matthaeis et al. .
5,069,189 12/1991 Saito .
5,076,236 12/1991 Yu et al. .
5,085,193 2/1992 Morikawa .
5,092,039 3/1992 Gaskell .
5,094,215 3/1992 Gustafson .
5,108,070 4/1992 Tominaga .
5,110,087 5/1992 Studtmann et al. .
5,121,730 6/1992 Ausman et al. .
5,125,807 6/1992 Kohler et al. .
5,131,624 7/1992 Kreuter et al. .
5,133,386 7/1992 Magee .
5,143,291 9/1992 Grinsteiner .
5,156,132 10/1992 Iwanaga .
5,161,779 11/1992 Graner et al. .
5,168,855 12/1992 Stone .
5,176,115 1/1993 Campion .
5,178,359 1/1993 Stobbs et al. .
5,181,494 1/1993 Ausman et al. .
5,188,336 2/1993 Graner et al. .
5,191,867 3/1993 Glassey .
5,207,201 5/1993 Schlagmuller et al. .
5,213,083 5/1993 Glassey .
5,219,122 6/1993 Iwanaga .
5,237,976 8/1993 Lawrence et al. .
5,244,002 9/1993 Frederick .
5,245,970 9/1993 Iwaszkiewicz et al. .
5,249,603 10/1993 Byers, Jr. .
5,251,659 10/1993 Sturman et al. .
5,251,671 10/1993 Hiroki .
5,261,366 11/1993 Regueiro .
5,261,374 11/1993 Gronenberg et al. .
5,269,269 12/1993 Kreuter .
5,271,371 12/1993 Meints et al. .
5,287,829 2/1994 Rose .
5,287,838 2/1994 Wells .
5,293,551 3/1994 Perkins et al. .
5,297,523 3/1994 Hafner et al. .
5,313,924 5/1994 Regueiro .
5,325,834 7/1994 Ballheimer et al. .
5,339,777 8/1994 Cannon .
5,345,916 9/1994 Amann et al. .
5,346,673 9/1994 Althausen et al. .
5,357,912 10/1994 Barnes et al. .
5,375,576 12/1994 Ausman et al. .
5,410,994 5/1995 Schecter .
5,423,302 6/1995 Glassey .
5,423,484 6/1995 Zuo .
5,429,309 7/1995 Stockner .
5,445,129 8/1995 Barnes .
5,447,138 9/1995 Barnes .
5,450,329 10/1995 Sturman .
5,460,329 10/1995 Sturman ..... 239/88 X
5,463,996 11/1995 Maley et al. .
5,477,828 12/1995 Barnes .
5,478,045 12/1995 Ausman et al. .
5,479,901 1/1996 Gibson et al. .
5,485,957 1/1996 Sturman .
5,487,368 1/1996 Bruning .
5,487,508 1/1996 Zuo .
5,492,098 2/1996 Hafner et al. .
5,492,099 2/1996 Maddock .
5,499,608 3/1996 Meister et al. .
5,499,609 3/1996 Evans et al. .
5,499,612 3/1996 Haughney et al. .
5,505,384 4/1996 Camplin .
5,509,391 4/1996 DeGroot .
5,515,829 5/1996 Wear et al. .
5,522,545 6/1996 Camplin et al. .
5,529,044 6/1996 Barnes et al. .
5,535,723 7/1996 Gibson et al. .
5,577,892 11/1996 Schittler et al. .
5,597,118 1/1997 Carter, Jr. et al. .
5,598,871 2/1997 Sturman et al. .
5,622,152 4/1997 Ishida .
5,632,444 5/1997 Camplin et al. ..... 239/88
5,638,781 6/1997 Sturman .
5,640,987 6/1997 Sturman .
5,641,148 6/1997 Pena et al. .
5,669,355 9/1997 Gibson et al. .

| | | | |
|---|---|---|---|
| 5,682,858 | 11/1997 | Chen et al. . | |
| 5,720,318 | 2/1998 | Nagarajan et al. | 239/88 X |
| 5,823,429 | 10/1998 | Beck et al. | 239/88 X |
| 5,871,155 | 2/1999 | Stockner et al. | 239/533.9 X |
| 5,878,958 | 3/1999 | Lambert | 239/88 |

OTHER PUBLICATIONS

SAE Technical Paper Series, Development of the HEUI Fuel System—Integration of Design, Simulation, Test and Manufacturing, A.R. Stockner, et al., Mar. 1–5, 1993.

SAE Technical Paper Series, "HEUI—A New Direction for Diesel Engine Fuel Systems," S.F. Glassey et al., Mar. 1–5, 1993.

Machine Design, Feb. 21, 1994, "Breakthrough in Digital Valves," Carol Sturman, Eddit Sturman.

Sturman Industries Gets Innovative All the Way!, The Bugle, Apr. 1993, vol. 19, Issue 4.

SuperFlow News, vol. 13, Spring 1998, "Sturman Tests Revolutionary Fuel Injectors".

INTENSIFIED FUEL INJECTOR HAVING A LATERAL DRAIN PASSAGE

BACKGROUND OF THE INVENTION

1. Field of the Invention

The present invention relates to a fuel injector.

2. Background Information

FIG. 1 shows a fuel injector that is disclosed in U.S. Pat. No. 5,460,329 issued to Sturman. The Sturman injector includes an hydraulically-driven intensifier 1 that can pressurize a fuel located within a fuel chamber 2. The pressurized fuel is ejected through one or more nozzle openings 3 in a tip 4 of the injector. The flow of fuel through the openings 3 is controlled by a spring-biased needle or check valve 5.

The intensifier 1 has a head 6 that is located within an intensifier chamber 7. The intensifier chamber 7 is hydraulically coupled to a control valve 8 which can control the flow of an hydraulic fluid into the chamber 7. The control valve 8 is typically a three-way valve which can selectively hydraulically couple the chamber 7 to either a high pressure rail line (not shown) or low pressure drain line (not shown). When hydraulically coupled to the rail line, the high pressure hydraulic fluid flows into the intensifier chamber 7 and pushes the intensifier 1 into a downward or pumping direction. The downward movement of the intensifier 1 pressurizes the fuel within the fuel chamber 2. The pressurized fuel pushes the needle valve 5 into an (upward) open position so that fuel is ejected or sprayed through the nozzle openings 3.

The injector includes a return spring 9 which pushes the intensifier 1 back to its original (upward) position when the control valve 8 hydraulically couples the chamber 7 to the drain line. The upward movement of the intensifier 1 also draws fuel into the fuel chamber 2 so that the process can be repeated. The spring-biased needle valve 5 is also pushed back into its closed (downward) position.

The return spring 9 is located within a spring chamber 10. Hydraulic fluid within the intensifier chamber 7 may leak past the outer peripheral surface of the head 6 and into the spring chamber 10. Any fluid within the spring chamber 10 may create an hydrostatic pressure which impedes or prevents the downward movement of the intensifier 1. To prevent the build-up of hydrostatic pressure, the injector 1 may contain a drain passage 11 that is hydraulically coupled to the spring passage 10. The drain passage 11 allows hydraulic fluid which leaks into the spring chamber 10 to flow out of the injector. The drain passage 11 extends along the longitudinal axis of the injector to an outlet port 12 located adjacent to the control valve 8.

The fuel injector is typically assembled into an internal combustion engine. By way of example, the fuel injector may eject diesel fuel into a diesel engine. It is desirable to reduce the size of the fuel injector to minimize the overall size and weight of the engine. The existence of the longitudinal drain passage limits the minimum diameter or cross-sectional area of the fuel injector. In addition to the diameter or cross-sectional area of the drain passage, the passage also requires an outer wall which increases the size of the injector. It would be desirable to provide a fuel injector which does not have a longitudinal drain passage.

SUMMARY OF THE INVENTION

One embodiment of the present invention is an intensified fuel injector which has a side drain passage. The fuel injector may include a valve body which has longitudinal axis. The valve body may have a fuel chamber that is hydraulically coupled to a fuel supply port and a nozzle opening. An intensifier moves within the fuel chamber. The intensifier is hydraulically coupled to an intensifier chamber and connected to a biasing spring. The spring is located within a spring chamber that is hydraulically coupled to the drain passage. The drain passage may extend through the valve body in a direction that is essentially perpendicular to the longitudinal axis of the body.

DETAILED DESCRIPTION OF THE INVENTION

One embodiment of the present invention is an intensified fuel injector which has a side drain passage. The fuel injector may include a valve body which has longitudinal axis. The valve body may have a fuel chamber that is hydraulically coupled to a fuel supply port and a nozzle opening. An intensifier moves within the fuel chamber. The intensifier is hydraulically coupled to an intensifier chamber and also connected to a biasing spring. The spring is located within a spring chamber that is hydraulically coupled to the drain passage. The drain passage may extend through the valve body in a direction that is substantially perpendicular to the longitudinal axis of the body. The orientation and location of the drain passage minimizes the diameter or cross-sectional area of the fuel injector by eliminating a longitudinal passage typically found in fuel injectors of the prior art.

Figure 1:
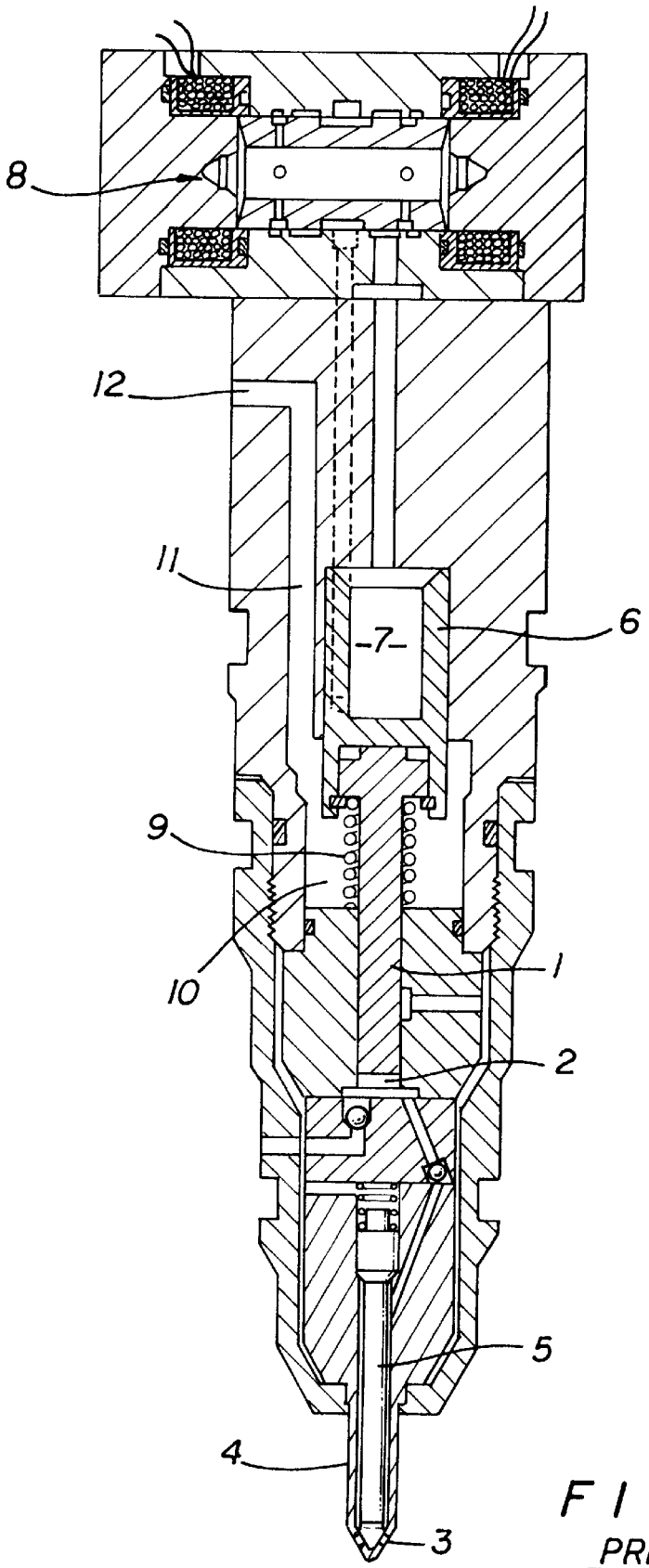
FIG. 1 PRIOR ART
FIG. 1 is a cross-sectional view of a fuel injector in the prior art.
Figure 2:
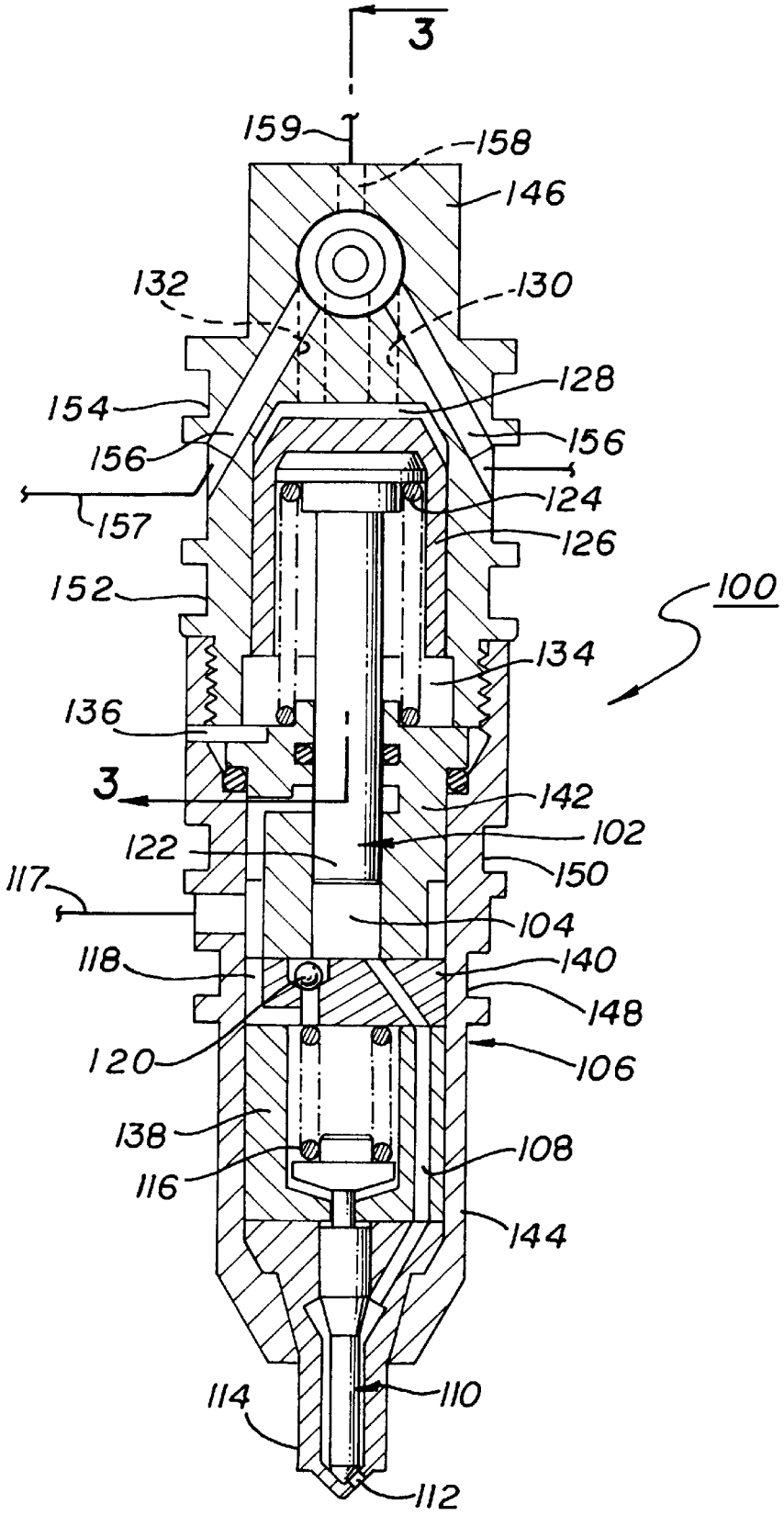
FIG. 2 is a cross-sectional view of an embodiment of a fuel injector of the present invention.

Referring to the drawings more particularly by reference numbers, FIG. 2 shows an embodiment of a fuel injector 100. The injector 100 includes an intensifier 102, movable between a retracted position and an extended position, that can pressurize a fuel located within a fuel chamber 104 of an injector body 106. The fuel chamber 104 is connected to a passage 108 which extends to a needle or check valve 110. The needle valve 110 controls the flow of fuel through one or more nozzle openings 112 located in a tip 114 of the injector 106. The needle valve 110 may be coupled to a return spring 116 which biases the valve 110 (downwardly) into a closed position. In the closed position, the needle valve 110 prevents fuel from flowing through the nozzle opening(s) 112. The fuel chamber 104 may also be coupled to a fuel line 117 by a fuel supply passage 118 and a one-way check valve 120.

The intensifier 102 may include a piston 122 that can move relative to the injector body 106 to either decrease or increase the volume of the fuel chamber 104. Movement of the piston 122 to decrease the volume of the fuel chamber 104 pressurizes the fuel within the chamber 104. The pressurized fuel pushes the needle valve 110 (upwardly) to an open position so that fuel is ejected from the nozzle opening(s) 112. Movement of the piston 122 to increase the volume of the fuel chamber 104 draws fuel into the chamber 104 through the passage 118 and past the check valve 120.

The piston 122 may be coupled to a return spring 124 that is captured by a cap 126. The spring 124 may bias the piston 122 to an upward or retracted position. The cap 126 is located within an intensifier chamber 128 that is hydraulically coupled to a pair of passages 130 and 132. Hydraulic fluid may flow into the chamber 128 through the passages 130 and 132. The flow of hydraulic fluid into the chamber 128 drives the intensifier 102 into a downward or pumping direction to pressurize the fuel within the fuel chamber 104. The cap 126 has an effective area that is larger than the effective area of the piston 122 within the fuel chamber 104 so that the fuel pressure in the fuel chamber 104 is greater than the pressure of the hydraulically fluid driving the intensifier 102. A flow of hydraulic fluid out of the intensifier chamber 128 allows the spring 124 to return the piston 122 to its original or retracted position so that the cycle can be repeated.

The spring 124 is located within a spring chamber 134. Some of the hydraulic fluid may leak across the outer peripheral surface of the cap 126 from the intensifier chamber 128 into the spring chamber 134. To drain any fluid leakage, the injector 100 may include at least one drain passage 136 that is hydraulically coupled directly to the spring chamber 134. As shown, the drain passage 136 may extend through the injector body 106 in a direction that is substantially perpendicular to the longitudinal axis of the injector body 106. The orientation and location of the passage 136 reduces the number of longitudinal passages in the injector 100. The reduction in longitudinal passages advantageously minimizes the diameter or cross-sectional area of the injector 100.

The valve body 106 may include blocks 138, 140 and 142 that are located within an outer injector housing 144. The injector housing 144 may be screwed into a valve housing 146. The injector housing 144 may have a first outer peripheral seal groove 148 and a second outer peripheral seal groove 150. The valve housing 146 may include a third outer peripheral seal groove 152 and a fourth outer peripheral seal groove 154. The seal grooves 148, 150, 152 and 154 typically contain O-rings (not shown) which seal the injector 100 into a cylinder head (not shown) of an internal combustion engine (not shown).

The fuel supply passage 118 may be located between the first and second seal grooves 148, 150. The drain passage 136 may be located between the second and third seal grooves 150, 152. One or more hydraulic fluid supply passages 156 may be located between the third and fourth seal grooves 152, 154 of the valve housing 148. The valve body 146 may also have at least one drain passage 158. The fluid supply passages 156 may be connected to an external high pressure rail line 157. The drain passage 158 may be connected to an external drain line 159.

Figure 3:
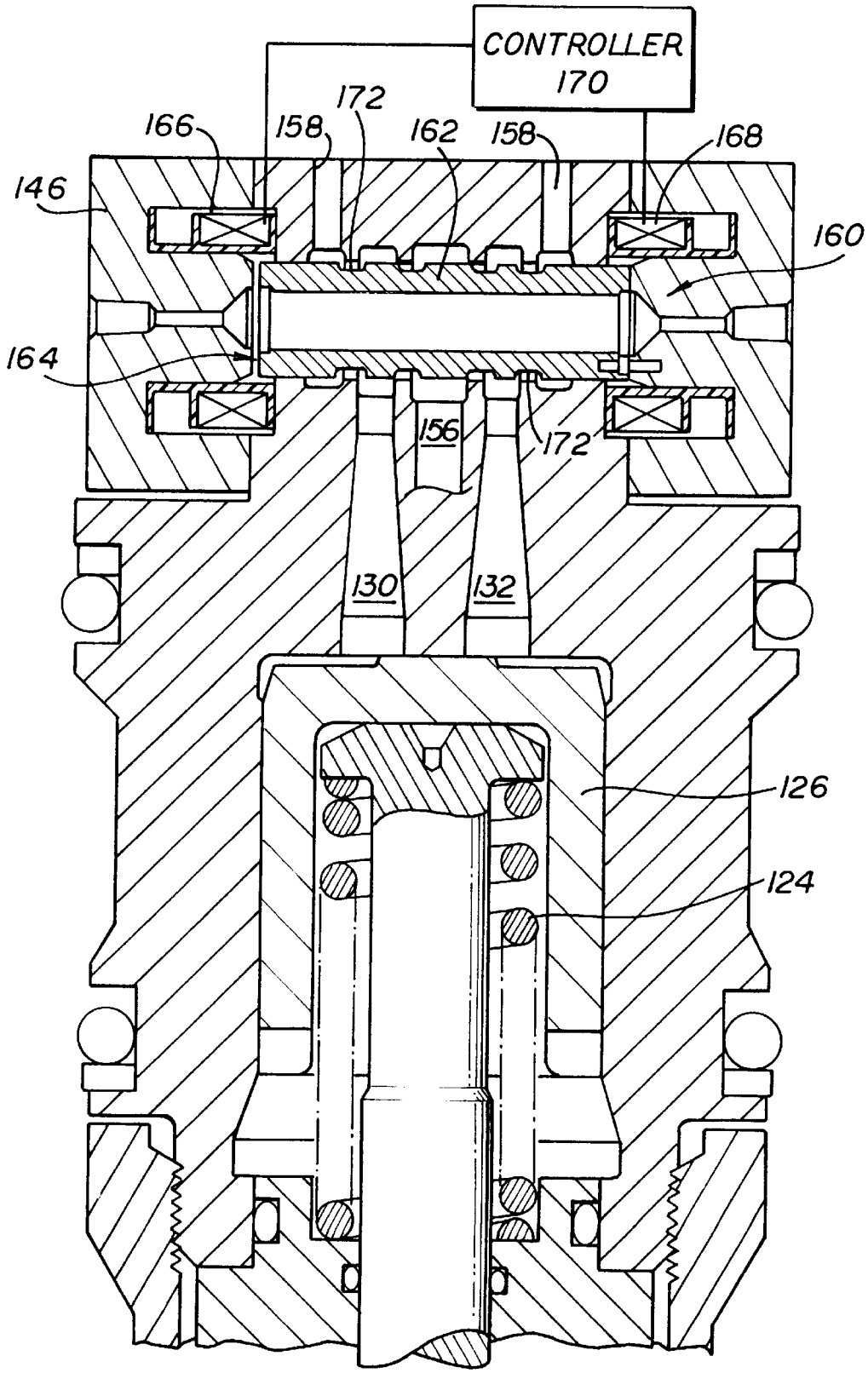
FIG. 3 is an enlarged cross-sectional partial view taken along line 3—3 of FIG. 2 showing a control valve of the fuel injector.

FIG. 3 shows a control valve 160 which controls the flow of hydraulic fluid through the passages 130 and 132. The valve 160 includes a spool 162 which moves within a spool chamber 164 positioned between a first coil 166 and a second coil 168. The valve 160 is electrically connected to an electronic controller 170 which can selectively provide electrical current to one of the coils 166 and 168 to move the spool 162 into one of two opposed positions.

The spool 162 has outer grooves 172 which hydraulically couple the passages 130 and 132 to the supply passages 156 when the spool 162 is in one (leftward) position. When the spool 162 is in the other (rightward) position, the passages 130 and 132 are hydraulically coupled to the drain passages 158. The spool 162 and valve body 146 may be constructed from 4140 steel which will retain enough residual magnetism to maintain the position of the spool 162 even when electrical current is not provided to the coils 166 and 168. In this manner, the controller 170 may switch the position of the spool 162 by providing a digital pulse to one of the coils 166 or 168. The control valve 160 may be similar to the valve disclosed in U.S. Pat. No. 5,640,987 issued to Sturman, which is hereby incorporated by reference.

Figure 4:
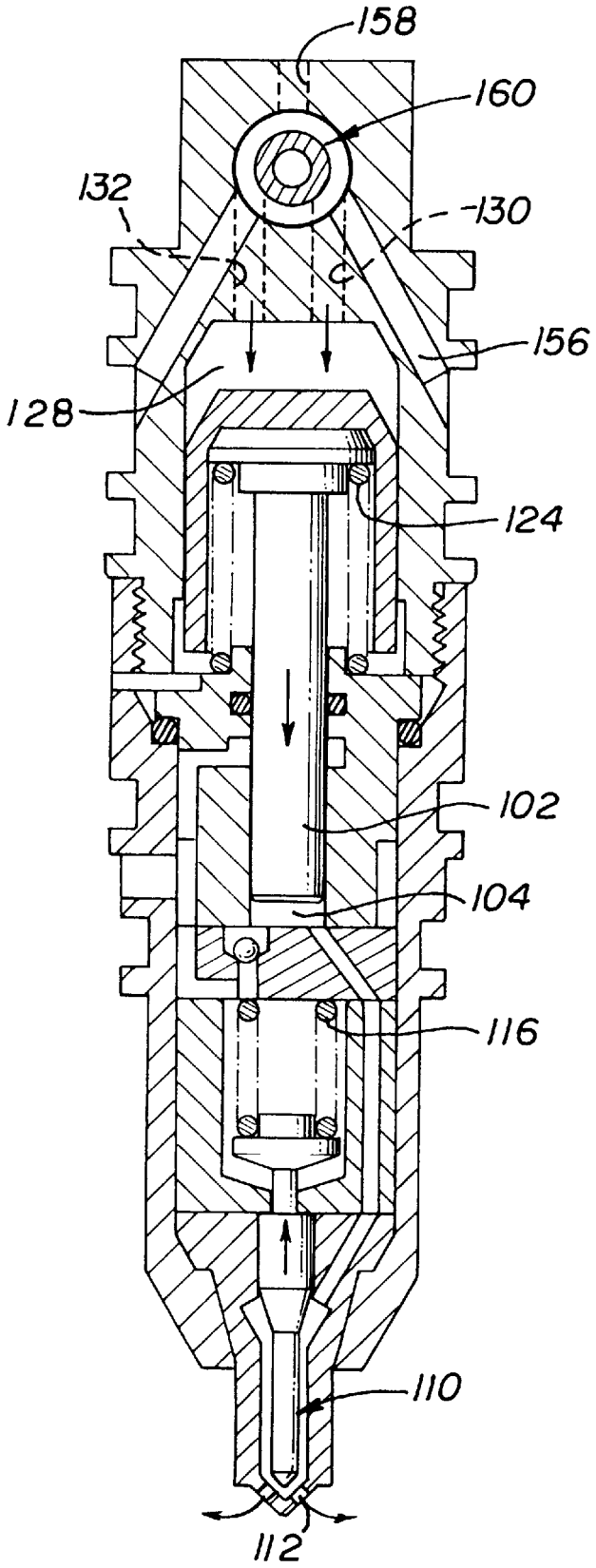
FIG. 4 is a view similar to FIG. 2 showing the injector ejecting fuel.

As shown in FIG. 4, in operation, the control valve 160 is switched by the controller 170 so that the passages 130 and 132 are hydraulically coupled to the supply passage(s) 156. Consequently, hydraulic fluid flows into the intensifier chamber 128 and drives the intensifier 102 in a downward or pumping direction. The movement of the intensifier 102 pressurizes the fuel within the fuel chamber 104. The pressurized fuel opens the needle valve 110 so that fuel is ejected from the nozzle openings 112.

The controller 170 then switches the valve 160 so that the passages 130 and 132 are coupled to the drain passage(s) 158. Coupling the passages 130, 132 to the drain passage(s) 158 lowers the pressure within the intensifier chamber 104 such that the return spring 124 pushes the intensifier 102 back to its original or retracted position. The upward movement of the intensifier 102 also reduces the pressure within the fuel chamber 104 and pulls fuel into the chamber 104. The reduction in fuel pressure within the chamber 104 allows the return spring 116 to move the needle valve 110 back to its original closed (downward) position so that the cycle can be repeated.

The drain passage 136 directly drains any hydraulic fluid leakage, which may be present in the spring chamber 134, laterally out of the injector body 106.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A fuel injector, comprising:

an injector body having a first seal groove, a second seal groove a third seal groove, a longitudinal axis, said injector body having a spring chamber, an intensifier chamber, and a fuel chamber that is hydraulically coupled to a fuel supply passage and at least one nozzle opening, said fuel supply passage extends through said injector body between said first and second seal grooves, said injector body further having a drain passage that is in fluid communication with said spring chamber and extends through said injector body between said second and third seal grooves;

an intensifier that is hydraulically coupled to said intensifier chamber and moves within said fuel chamber between a retracted position and an extended position; and, a spring that is located within said spring chamber and which biases said intensifier towards its retracted position.

2. The fuel injector of claim 1, further comprising a control valve operable to control a flow of an hydraulic fluid into and out of said intensifier chamber.

3. The fuel injector of claim 2, wherein said control valve is a three-way valve.

4. The fuel injector of claim 3, wherein said control valve includes a spool that is movable between a first position and a second position.

5. The fuel injector of claim 4, wherein said spool is maintained in one of the positions by a residual magnetism of said control valve.

6. The fuel injector of claim 1, further comprising a check valve located adjacent to said nozzle opening.

7. A fuel injector, comprising:

an injector body having a first seal groove, a second seal groove and a third seal groove, said injector body having a spring chamber, an intensifier chamber, and a fuel chamber that is hydraulically coupled to a fuel supply passage and at least one nozzle opening, said injector body having at least one drain passage that is in fluid communication with said spring chamber extends through said injector body between said second and third seal grooves;

an intensifier that is hydraulically coupled to said intensifier chamber and movable within said fuel chamber between a retracted position and an extended position; and, a spring that is located within said spring chamber and which biases said intensifier towards its retracted position.

8. The fuel injector of claim 7, further comprising a control valve operable to control a flow of an hydraulic fluid into and out of said intensifier chamber.

9. The fuel injector of claim 8, wherein said control valve is a three-way valve.

10. The fuel injector of claim 9, wherein said control valve includes a spool that is movable between a first position and a second position.

11. The fuel injector of claim 10, wherein said spool is maintained in one of the positions by a residual magnetism of said control valve.

12. The fuel injector of claim 7, further comprising a check valve located adjacent to said nozzle opening.

* * * * *

UNITED STATES PATENT AND TRADEMARK OFFICE

CERTIFICATE OF CORRECTION

PATENT NO. : 6,085,991
DATED : July 11, 2000
INVENTOR(S) : Struman

It is certified that error appears in the above-identified patent and that said Letters Patent is hereby corrected as shown below:

Title page,
Item [56] Foreign Patent Documents, insert the following:
-- EP 0 789143 August 13, 1997 European Pat. Off.
WO 93 13309 July 8, 1993 PCT --.
Under the References Cited, U.S. PATENT DOCUMENTS, insert -- 4,544,096 -- before "4,550,875".

Signed and Sealed this

Fourteenth Day of May, 2002

*Attest:*

*Attesting Officer*

JAMES E. ROGAN
*Director of the United States Patent and Trademark Office*